US008512058B2

(12) United States Patent
Ozeki

(10) Patent No.: US 8,512,058 B2
(45) Date of Patent: Aug. 20, 2013

(54) ELECTRICAL CONNECTOR

(75) Inventor: Kosuke Ozeki, Tokyo (JP)

(73) Assignee: Dai-Ichi Seiko Co., Ltd. (JP)

( * ) Notice: Subject to any disclaimer, the term of this patent is extended or adjusted under 35 U.S.C. 154(b) by 94 days.

(21) Appl. No.: 13/311,305

(22) Filed: Dec. 5, 2011

(65) Prior Publication Data

US 2012/0164882 A1 Jun. 28, 2012

(30) Foreign Application Priority Data

Dec. 27, 2010 (JP) ..... 2010-290837

(51) Int. Cl.
*H01R 13/62* (2006.01)

(52) U.S. Cl.
USPC ..... 439/260

(58) Field of Classification Search
USPC ..... 439/260, 495
See application file for complete search history.

(56) References Cited

U.S. PATENT DOCUMENTS

| | | | | |
|---|---|---|---|---|
| 7,001,208 | B2 * | 2/2006 | Huang | 439/495 |
| 7,377,803 | B2 * | 5/2008 | Matsuoka | 439/497 |
| 7,914,321 | B2 * | 3/2011 | Huang | 439/495 |
| 8,221,147 | B2 * | 7/2012 | Ozeki | 439/260 |
| 8,376,762 | B2 * | 2/2013 | Ozeki | 439/153 |
| 8,398,417 | B2 * | 3/2013 | Ozeki | 439/260 |
| 2004/0248447 | A1 * | 12/2004 | Aoki | 439/260 |
| 2005/0227531 | A1 * | 10/2005 | Yang | 439/495 |
| 2012/0208385 | A1 * | 8/2012 | Ozeki | 439/153 |
| 2012/0220171 | A1 * | 8/2012 | Shimada et al. | 439/660 |

FOREIGN PATENT DOCUMENTS

| | | |
|---|---|---|
| JP | 2008-052993 A | 3/2008 |
| JP | 2008-192574 A | 8/2008 |

* cited by examiner

*Primary Examiner* — Tho D Ta
*Assistant Examiner* — Larisa Tsukerman
(74) *Attorney, Agent, or Firm* — Studebaker & Brackett PC

(57) ABSTRACT

An electrical connector including a housing having an opening through which an FPC is inserted into the housing, conductive contacts arranged on the housing for contacting with signal connecting terminals on the FPC, and a conductive shell member mounted on the housing and provided therein with a holding portion for holding the FPC inserted in the housing and a releasing portion for releasing the FPC from holding by the holding portion, wherein the holding portion extends into the housing from an end wall portion of the conductive shell member covering a side end portion of the housing to engage with the FPC and the releasing portion is movable in an operating direction intersecting a direction of arrangement of the conductive contacts and provided thereon with an engaging projection for engaging with the holding portion to release the same from the engagement with the FPC.

9 Claims, 12 Drawing Sheets

ELECTRICAL CONNECTOR

BACKGROUND OF THE INVENTION

1. Field of the Invention

The present invention relates generally to an electrical connector, and more particularly to an improvement in an electrical connector which has a housing, holding means for engaging with a flat circuit device, such as a flexible printed circuit board (hereinafter, referred to as an FPC) or a flexible flat cable assembly (hereinafter, referred to as an FFC) inserted in the housing, so as to hold the same to be prevented from getting out of the housing unwillingly, and a plurality of conductive contacts provided for coming into contact with connecting terminals provided on the flat circuit device so as to put the flat circuit device in electrical connection with another electrical device, such as a solid circuit board.

2. Description of Related Art Including Information Disclosed Under 37 CFR 1.97 and 37 CFR 1.98

A flat circuit device, such as a relatively small-sized FPC or FFC, used in various kinds of electronic apparatus is often mounted on a solid circuit board, on which various electrical parts are directly mounted, with an electrical connector which is fixed to and connected electrically with the solid circuit board. The electrical connector has a plurality of conductive contacts, an end portion of each of which is connected electrically with a conductive circuit pattern portion formed on the solid circuit board and which are provided for coming into contact with connecting terminals provided on the flat circuit device, and is operative to connect electrically, through the conductive contacts, each of the connecting terminals provided on the flat circuit device with the conductive circuit pattern portion formed on the solid circuit board.

A first type of previously proposed electrical connector used for connecting electrically a flat circuit device, such as an FPC, with a solid circuit board, has a housing made of insulator, which is mounted on the solid circuit board and has an opening through which at least a part of the flat circuit device is inserted into the housing. On the housing, a plurality of conductive contacts are provided to be arranged along the opening provided also on the housing. These conductive contacts are operative to come into contact respectively with a plurality of connecting terminals provided on the flat circuit device when the flat circuit device is inserted in the housing through the opening provided thereon. The previously proposed electrical connector of the first type is also provided with a conductive shell member which covers wholly or partially the housing and is grounded to be operative to contribute to adjustment on characteristic impedance of each of the conductive contacts and to shield the conductive contacts in the housing from electromagnetic wave noises coming from the outside. The previously proposed electrical connector of the first type is further provided with an actuator which is provided to be rotatable in regard to the housing so as to engage with each of the conductive contacts arranged in the housing. When the actuator is rotated in a first direction in regard to the housing, an operating portion of each of the conductive contacts is moved by the actuator to put the conductive contact in press-contact with a corresponding one of the connecting terminals provided on the flat circuit device, and then, when the actuator is rotated in a second direction opposite to the first direction in regard to the housing, the conductive contacts put in press-contact with the connecting terminals provided on the flat circuit device are released from the press-contact with the connecting terminals. With the conductive contacts put in press-contact with the connecting terminals which are provided on the flat circuit device inserted in the housing, the flat circuit device is put in electrical connection with the solid circuit board.

A second type of previously proposed electrical connector used for connecting electrically the flat circuit device with the solid circuit board is provided with a housing to be mounted on the solid circuit board, a plurality of conductive contacts and a conductive shell member in such a manner as mentioned above but is not provided with an actuator rotatable in regard to the housing. In the previously proposed electrical connector of the second type thus constituted, when the flat circuit device is inserted into the housing through an opening provided thereon, each of the conductive contacts provided in the housing to be arranged along the opening is automatically put in press-contact with a corresponding one of connecting terminals provided on the flat circuit device. That is, the flat circuit device is put in electrical connection with the solid circuit board by means of only inserting correctly the flat circuit device into the housing through the opening provided thereon.

In the previously proposed electrical connector with or without the actuator rotatable in regard to the housing, when the flat circuit device is inserted into the housing through the opening provided thereon and the conductive contacts arranged on the housing are put in press-contact with the connecting terminals provided on the flat circuit device so that the flat circuit device is put in electrical connection with the solid circuit board, it is required to prevent the flat circuit device inserted in the housing from getting out of the housing unwillingly. It is a matter of course that it is necessary for the flat circuit device inserted in the housing to be held stably so as not to get out of the housing unwillingly in order to keep the conductive contacts arranged on the housing properly in a condition of press-contact with the connecting terminals provided on the flat circuit device.

There has been also proposed previously an electrical connector belonging to the above mentioned first type having the housing, the conductive contacts, the conductive shell member and the actuator, which is provided also with holding means for engaging with a flat circuit device, such as an FPC or an FTC, inserted in the housing so as to hold the same to be prevented from getting out of the housing unwillingly, as shown in, for example, the Japanese patent application published before examination under publication number 2008-52993 (hereinafter, referred to as published patent document 1).

Besides, there has been further proposed previously an electrical connector belonging to the above mentioned second type having the housing, the conductive contact and the conductive shell member except the actuator rotatable in regard to the housing, which is provided also with holding means for engaging with a flat circuit device, such as an FPC or an FFC, inserted in the housing so as to hold the same to be prevented from getting out of the housing unwillingly, as shown in, for example, the Japanese patent application published before examination under publication number 2008-192574 (hereinafter, referred to as published patent document 2).

In the electrical connector shown in the published patent document 1, the holding means (a locking portion 11*c*) is formed in a part of the conductive shell member (a shield plate 11) to be able to seesaw with an engaging end portion (a claw portion 11*d*) curved to the inside of the conductive shell member. The holding means shifts its position in response to a movement of the actuator (an actuator 9) provided to be rotatable in regard to the housing (a housing 3).

Then, when the actuator is rotated in a first direction in regard to the housing after the flat circuit device (an FPC 21)

is inserted into a receiving space (an FPC receiving space 34) provided in the housing, each of the conductive contacts (first contacts 5 and second contacts 6) provided in the housing is caused by a cam (a cam portion 92 or 93) formed on the actuator to shift its position so as to be put in press-contact with a corresponding one of connecting terminals provided on the flat circuit device inserted in the housing and the holding means is caused by a com (a cam portion 94) formed on the actuator to shift its position so as to cause the engaging end portion of the holding means to engage with an engaging portion (a recess 21*a*) formed on the flat circuit device. As a result, the flat circuit device inserted in the housing is prevented from getting out of the housing unwillingly.

After that, when the actuator is rotated in a second direction opposite to the first direction in regard to the housing under a condition wherein the engaging end portion of the holding means is put in engagement with the engaging portion formed on the flat circuit device, the cam (the cam portion 94) formed on the actuator allows the holding means to release the engaging end portion of the holding means from the engagement with the engaging portion formed on the flat circuit device. As a result, the flat circuit device is put in a condition to be able to get out of the housing.

Further, in the electrical connector shown in the published patent document 2, the conductive shell member (a shell 4) is provided to be rotatable in regard to the housing (a housing body 2) and the holding means (a leg portion 46) in the form of a leaf spring is formed in a part of the conductive shell member. The holding means has an engaging projection (44) formed at an end of the holding means to be curved to the inside of the shell member.

When the flat circuit device (an FPC) is inserted into the housing through the opening (an opening 21) provided thereon under a condition wherein the shell member is positioned to keep lying down on the housing so as to be close in its entirety to the housing, each of the conductive contacts (upper contacts 31 and lower contacts 32) provided in the housing is caused to be put in press-contact with a corresponding one of connecting terminals provided on the flat circuit device inserted in the housing and the engaging projection formed on the holding means is caused to engage with an engaging portion (an FPC engaging hole 2) provided on the flat circuit device. As a result, the flat circuit device inserted in the housing is prevented from getting out of the housing unwillingly.

After that, when the conductive shell member is rotated to be positioned to keep rising from the housing under a condition wherein the engaging projection formed on the holding means is put in engagement with the engaging portion formed on the flat circuit device, the holding means formed in the conductive shell member shifts its position in response to a movement of the conductive shell member so as to release the engaging projection provided on the holding means from the engagement with the engaging portion formed on the flat circuit device. As a result, the flat circuit device is put in a condition to be able to get out of the housing.

In each of the electrical connectors thus proposed previously, which has the holding means operative to prevent the flat circuit device inserted in the housing from getting out of the housing unwillingly, the holding means is provided to be operative to shift its position in response to rotational movements of the actuator provided to be rotatable in regard to the housing, or the conductive shell member for covering wholly or partially the housing is provided to be rotatable in regard to the housing and the holding means is formed in a part of the conductive shell member to be operative to prevent the flat circuit device inserted in the housing from getting out of the housing unwillingly.

In the case of the previously proposed electrical connector which has the holding means operative to shift its position in response to the rotational movements of the actuator provided to be rotatable in regard to the housing, it is required that the holding means and the actuator are provided as separate parts independent from each other and this results in problems or disadvantages that miniaturization in the electrical connector is undesirably hindered, the number of constitutive parts of the electrical connector increases undesirably, and a production cost of the electrical connector rises disagreeably. Besides, it is necessary, for causing the holding means to engage with or disengage from the flat circuit device inserted in the housing, to rotate the actuator in regard to the housing and this results in undesirable increase in an open space around the electrical connector.

In the case of the previously proposed electrical connector which has the conductive shell member provided to be rotatable in regard to the housing and the holding means formed in the part of the conductive shell member, since the conductive shell member is operative to rotate in regard to the housing, any part of the conductive shell member not be used for fastening the electrical connector to the solid circuit board so that a separate holding-down member for fastening the electrical connector to the solid circuit board is required and this results in problems or disadvantages that miniaturization in the electrical connector is undesirably hindered, the number of constitutive parts of the electrical connector increases undesirably, and a production cost of the electrical connector rises disagreeably.

BRIEF SUMMARY OF THE INVENTION

Accordingly, it is an object of the present invention to provide an electrical connector used for connecting electrically a flat circuit device, such as an FPC or an FFC, with a solid circuit board, which comprises a housing provided thereon with an opening through which a flat circuit device is inserted into the housing, a plurality of conductive contacts provided to be arranged on the housing and a conductive shell member covering partially the housing, and which avoids the aforementioned disadvantages encountered with the prior art.

Another object of the present invention is to provide an electrical connector used for connecting electrically a flat circuit device, such as an FPC or an FFC, with a solid circuit board, which comprises a housing provided thereon with an opening through which a flat circuit device is inserted into the housing, a plurality of conductive contacts provided to be arranged on the housing and a conductive shell member covering partially the housing, and in which the flat circuit device inserted in the housing can be put in holding by a holding member formed in the conductive shell member to be surely prevented from getting out of the housing unwillingly and then released from the holding by the holding member to be able to get out of the housing with a structure in which the electrical connector can be miniaturized on the whole and the number of structural parts can be reduced.

A further object of the present invention is to provide an electrical connector used for connecting electrically a flat circuit device, such as an FPC or an FFC, with a solid circuit board, which comprises a housing provided thereon with an opening through which a flat circuit device is inserted into the housing, a plurality of conductive contacts provided to be arranged on the housing and a conductive shell member covering partially the housing, and in which the flat circuit device inserted in the housing can be easily released from holding by a holding portion formed in the conductive shell member with a considerably simple manipulation to a releasing portion formed in the conductive shell member.

According to the present invention, as claimed in any one of claims, there is provided an electrical connector, which comprises a housing made of insulator to be mounted on a solid circuit board and provided thereon with an opening through which a flat circuit device, such as an FPC or an FFC, is inserted into the housing, a plurality of conductive contacts arranged on the housing, each of which has a contacting portion positioned in the housing and a connecting terminal portion projecting from the housing to the outside thereof and is operative to come into contact with a connecting terminal provided on the flat circuit device inserted in the housing through the opening provided thereon, and a conductive shell member mounted on the housing for covering partially the same and provided with a holding portion formed integrally therein to be put in engagement with the flat circuit device inserted in the housing for holding the same and a releasing portion formed integrally therein to be manipulated to release the holding portion from the engagement with the flat circuit device inserted in the housing, wherein the holding portion extends into the inside of the housing from each of a pair of end wall portions of the conductive shell member covering respectively a pair of side end portions of the housing to be movable for engaging with the flat circuit device inserted in the housing and then disengaging from the flat circuit device inserted in the housing, and the releasing portion is connected with the conductive shell member to be movable entirely in an operating direction which intersects the direction along which the conductive contacts are arranged and provided thereon a manipulatable part elongating in a direction along which the conductive contacts are arranged and an engaging projection operative to engage with the holding portion to shift the same so that the holding portion is released from the engagement with the flat circuit device inserted in the housing.

In the electrical connector thus constituted in accordance with the present invention, when the flat circuit device on which the connecting terminals are provided is inserted into the housing thorough the opening provided thereon, the contacting portion of each of the conductive contacts arranged on the housing comes into contact with a corresponding one of the connecting terminals provided on the flat circuit device inserted in the housing, and the holding portion formed integrally in the shell member, which extends into the inside of the housing from each of the pair of end wall portions of the conductive shell member to be movable for engaging with the flat circuit device inserted in the housing and then disengaging from the flat circuit device inserted in the housing, is put in engagement with the flat circuit device inserted in the housing for holding the same. As a result, the flat circuit device inserted in the housing is held by the holding member so as to be prevented from getting out of the housing unwillingly and the conductive contacts arranged on the housing are stably kept in contact with the connecting terminals provided on the flat circuit device inserted in the housing.

Then, when the manipulatable part of the releasing portion, which is formed integrally, together with the holding portion, in the conductive shell member to elongate in the direction along which the conductive contacts are arranged, is manipulated, for example, to be moved toward the housing by pressing, for releasing the holding portion from the engagement with the flat circuit device inserted in the housing, the releasing member operates to move, together with the engaging projection, in the operating direction intersecting the direction along which the conductive contacts are arranged and thereby the engaging projection is operative to engage with the holding portion to move the same so that the holding portion is released from the engagement with the flat circuit device inserted in the housing. As a result, the flat circuit device inserted in the housing is released from holding by the holding member so as to be able to get out of the housing.

Functions or roles of the respective portions of the electrical connector constituted as mentioned above in accordance with the present invention are further explained in the concrete as follows, for example.

In the electrical connector according to the present invention, each of the holding portion and the releasing portion formed integrally in the conductive shell member is, for example, provided to constitute a resilient movable portion. The holding portion is, for example, formed to extend from the end wall portion of the conductive shell member toward the opening on the housing through which the flat circuit device is inserted into the housing and provided thereon with an engaging opening. A portion of an opening forming part of the holding portion which forms the engaging opening is operative to engage with the flat circuit device inserted in the housing. The releasing portion is, for example, provided thereon with a pair of engaging projections at ends of the manipulatable part opposite to each other in the direction along which the conductive contacts are arranged and operative to move in the operating direction, which intersects the direction along which the conductive contacts are arranged, with a linear fulcrum placed between the manipulatable part and the conductive shell member when the manipulatable part is manipulated by pressing.

When the manipulatable part of the releasing portion is manipulated to be moved toward the housing by pressing under a condition wherein the flat circuit device inserted in the housing is put in holding by the holding portion, the releasing portion is moved entirely in the operating direction, which intersects the direction along which the conductive contacts are arranged, with the linear fulcrum placed between the manipulatable part and the conductive shell member and thereby the engaging projection of the releasing portion engages with the holding portion to shift the same so that the holding portion is released from the engagement with the flat circuit device inserted in the housing. Then, when the manipulatable part of the releasing portion is released from manipulation by pressing for shifting the manipulatable part toward the housing, each of the holding portion and the releasing portion is restored to its former condition by means of its own restoring resilient force.

On that occasion, the holding portion is, for example, operative to move with a linear fulcrum placed between the holding portion and the end wall portion of the conductive shell member under a condition wherein a guiding projection provided on the housing is inserted into the engaging opening provided on the holding portion and the opening forming part of the holding portion is guided by the guiding projection provided on the housing, or operative to move to approach the end wall portion of the conductive shell member with a linear fulcrum placed between the holding portion and the end wall portion of the conductive shell member when the engaging projection of the releasing portion comes into press-contact with a slant surface provided on a free-end part extending from the opening forming part of the holding portion and moves in the operating direction intersecting the direction along which the conductive contacts are arranged. With such operations of the holding portion, the movements of the holding portion with the linear fulcrum placed between the holding portion and the end wall portion of the conductive shell member are smoothly carried out.

Further, when the manipulatable part of the releasing portion is manipulated by pressing under the condition wherein the flat circuit device inserted in the housing is put in holding by the holding portion, the releasing portion is, for example, operative to cause the engaging projection to come into press-contact with the holding portion and also to move in the operating direction intersecting the direction along which the conductive contacts are arranged so that the holding portion is moved to approach the end wall portion of the conductive shell member with the linear fulcrum placed between the holding portion and the end wall portion of the conductive shell member and thereby the flat circuit device inserted in the housing is released from holding by the holding portion. With such operations of the releasing portion, the release of the flat circuit device from the holding by the holding portion is smoothly and surely carried out.

With the electrical connector constituted in accordance with the present invention, as described above, when the flat circuit device, such as the FPC, the FTC and so on, is inserted into the housing thorough the opening provided thereon, the contacting portion of each of the conductive contacts arranged on the housing comes into contact with the corresponding one of the connecting terminals provided on the flat circuit device inserted in the housing and the holding portion formed integrally in the conductive shell member is put in engagement with the flat circuit device inserted in the housing for holding the same. As a result, the flat circuit device inserted in the housing is held by the holding portion of the conductive shell member so as to be prevented from getting out of the housing unwillingly and the conductive contacts arranged on the housing are stably kept in electrical connection with the connecting terminals provided on the flat circuit device inserted in the housing.

Then, when the releasing portion formed integrally in the conductive shell member in addition to the holding portion is manipulated to release the holding portion from the engagement with the flat circuit device inserted in the housing under the condition wherein the flat circuit device inserted in the housing is put in holding by the holding portion, the releasing portion is moved to engage with the holding portion for shifting the same so that the holding portion is released from the engagement with the flat circuit device. As a result, the flat circuit device inserted in the housing is released from the holding by the holding portion so as to be able to get out of the housing.

Accordingly, with the electrical connector according to the present invention, the flat circuit device inserted in the housing can be put in holding by the holding portion formed integrally in the conductive shell member to be surely prevented from getting out of the housing unwillingly and then released from the holding by the holding portion to be able to get out of the housing with an improved structure with which the electrical connector can be miniaturized on the whole and the number of structural parts can be reduced with the holding portion and the releasing portion each formed integrally in the conductive shell member.

Further, in the electrical connector thus constituted in accordance with the present invention, the flat circuit device inserted in the housing and put in holding by the holding portion formed integrally in the conductive shell member is released from the holding by the holding portion only with manipulation on the manipulatable part of the releasing portion formed integrally in the conductive shell member for moving the releasing portion in the operating direction intersecting the direction along which the conductive contacts are arranged. On that occasion, the manipulation on the manipulatable part of the releasing portion is, for example, done with pressing the manipulatable part and therefore considerably simple. Further, since the manipulatable part of the releasing portion elongates in the direction along which the conductive contacts are arranged, the manipulation applied on the manipulatable part of the releasing portion can be easily and surely carried out. Consequently, the flat circuit device inserted in the housing can be easily released from holding by the holding portion with a considerably simple and easy manipulation to the releasing portion.

The above, and other objects, features and advantages of the present invention will become apparent from the following detailed description taken in conjunction with the accompanying drawings.

DETAILED DESCRIPTION OF THE INVENTION

Figure 1:
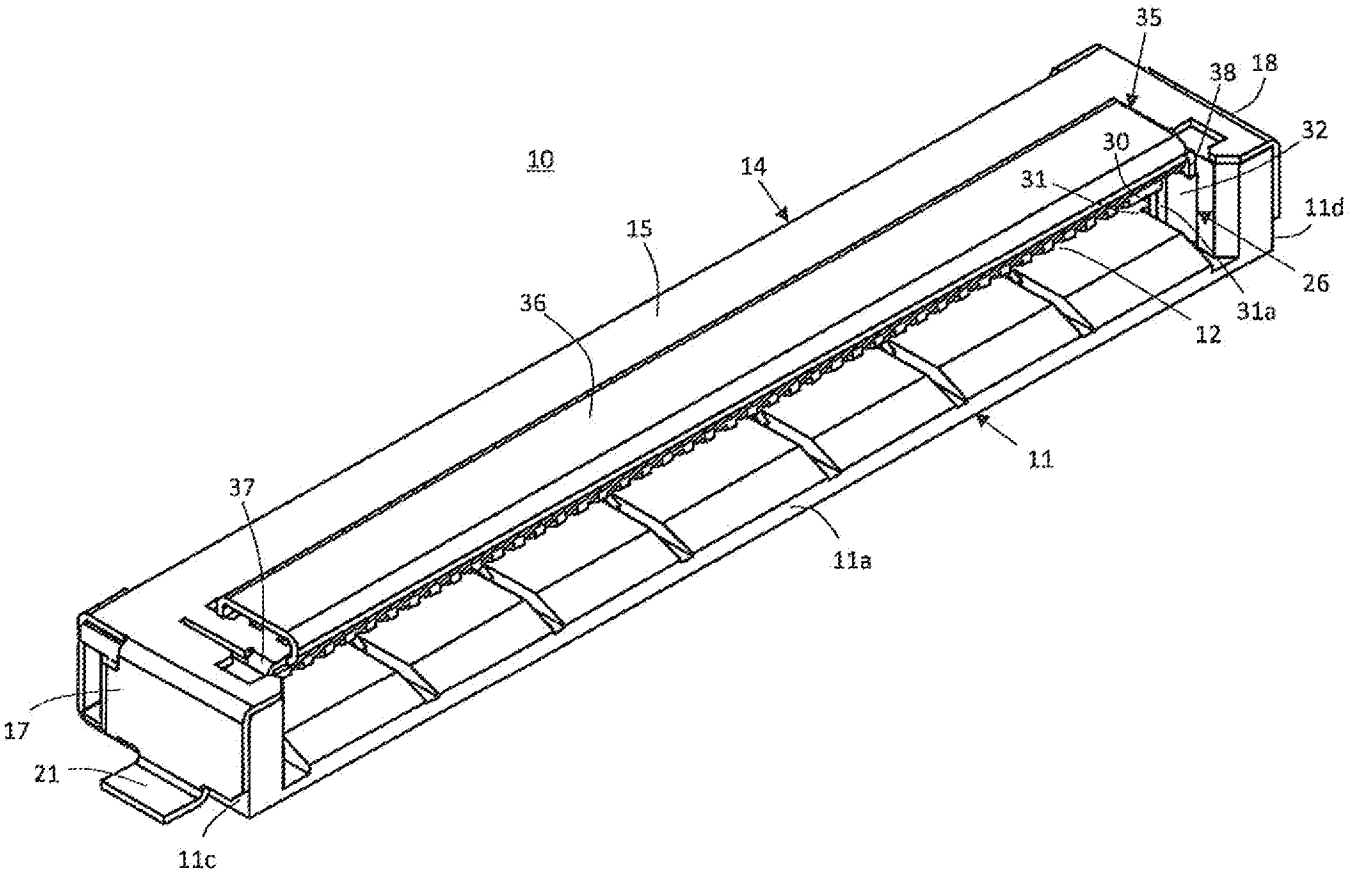
FIG. 1 is a schematic front, top and left side perspective view showing an embodiment of electrical connector according to the present invention.
Figure 2:
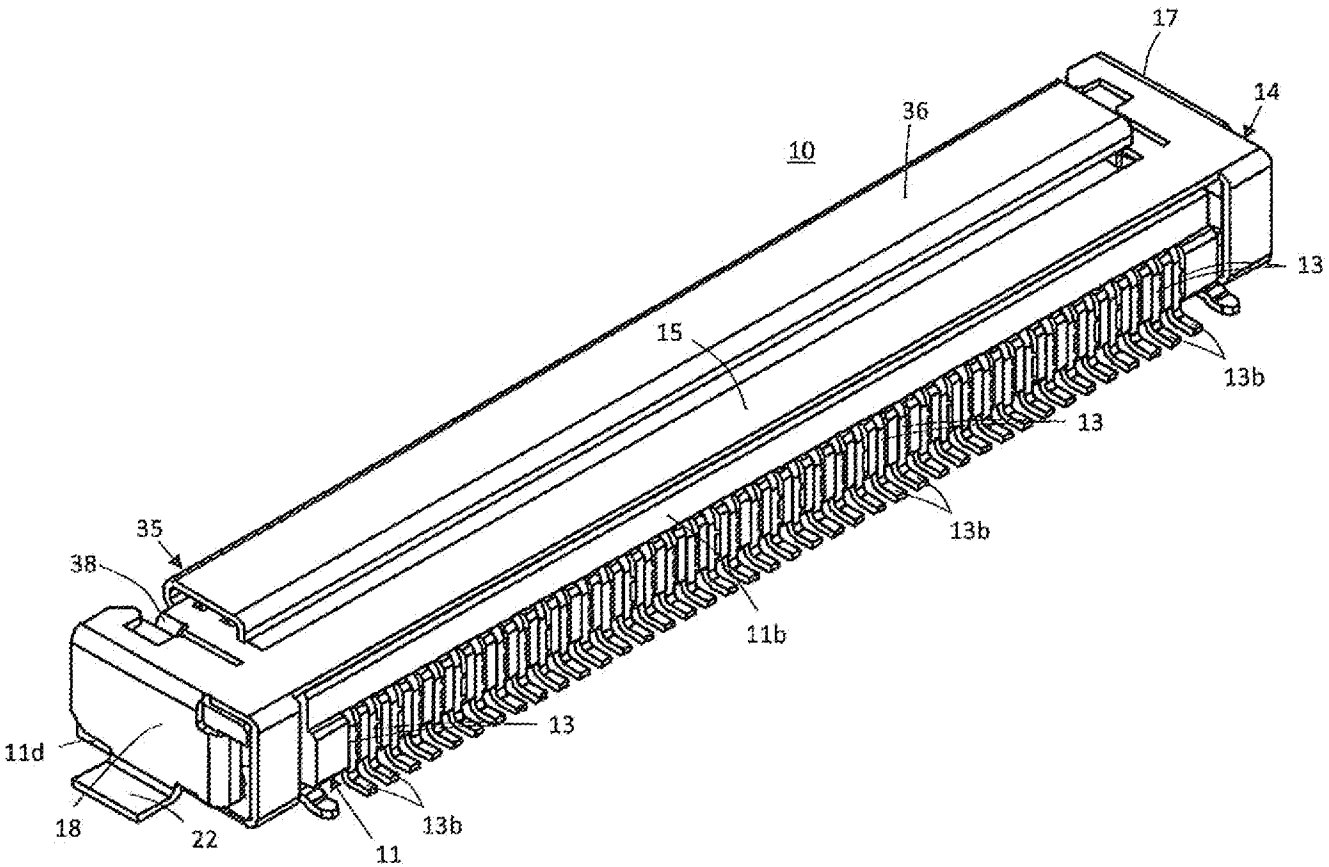
FIG. 2 is a schematic rear, top and right side perspective view showing the embodiment shown in FIG. 1.
Figure 3:
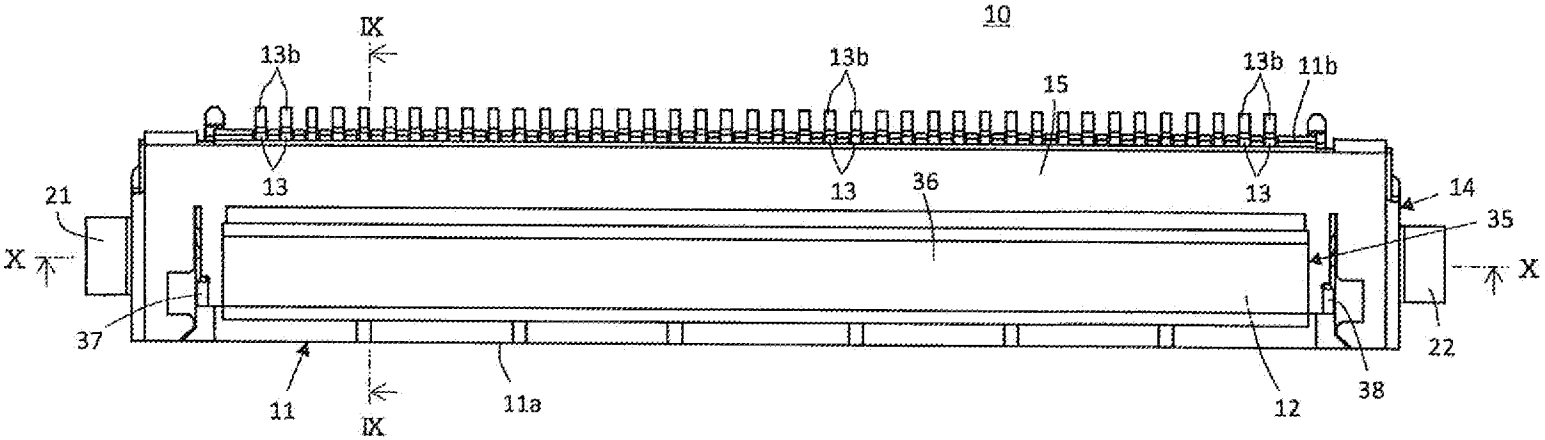
FIG. 3 is a schematic plan view showing the embodiment shown in each of FIGS. 1 and 2.
Figure 4:
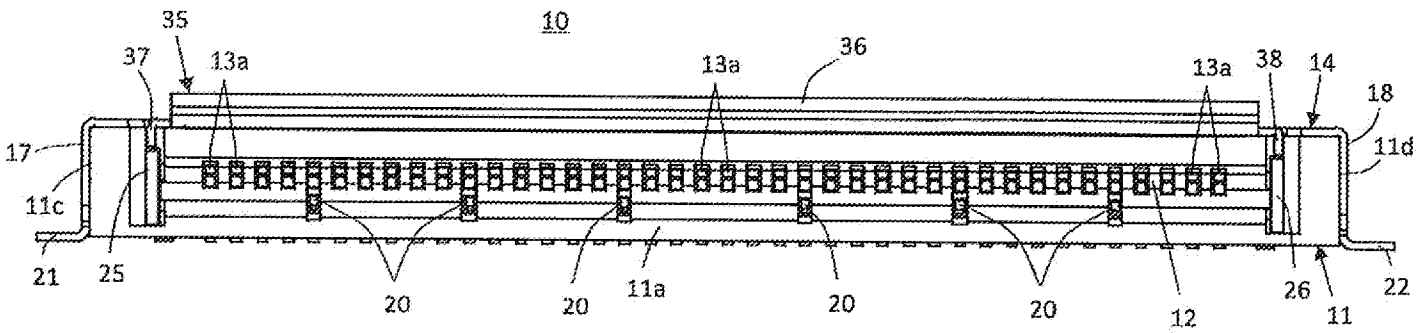
FIG. 4 is a schematic front view showing the embodiment shown in each of FIGS. 1 and 2.
Figure 5:
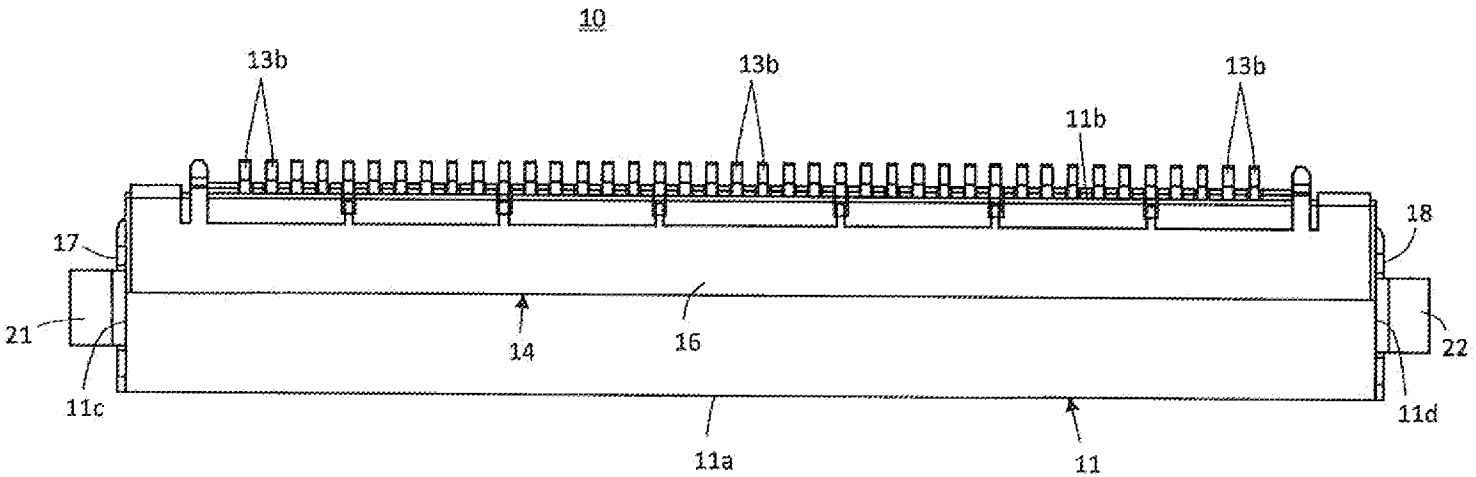
FIG. 5 is a schematic bottom view showing the embodiment shown in each of FIGS. 1 and 2.

Each of FIG. 1 which is a schematic front, top and left side perspective view, FIG. 2 which is a schematic rear, top and right side perspective view, FIG. 3 which is a schematic plan view, FIG. 4 which is a schematic front view and FIG. 5 which is a schematic bottom view, shows an embodiment of electrical connector according to the present invention.

Hereinafter, for the sake of clear explanations, upper, lower, left and right sides of a front view shown in FIG. 4 are referred to as upper or top, lower or bottom, left and right portions or parts, respectively.

Referring to FIGS. 1 to 5, an electrical connector 10, which constitutes the embodiment of electrical connector according to the present invention, has a housing 11 made of, for example, insulator such as plastics or the like. The housing 11 has a front end portion 11*a* and a rear end portion 11*b* which constitute a first pair of opposite end portions of the housing 11, and a left side end portion 11*c* and a right side end portion 11*d* which constitute a second pair of opposite end portions of the housing 11. Further, the housing 11 is provided thereon with an opening 12 which opens on the front end portion 11*a* of the housing 11 and extends from the front end portion 11*a* of the housing 11 through an inside of the housing 11 toward the rear end portion 11*b* of the housing 11. When the electrical connector 10 is put in practical use, the housing 11 is mounted on a solid circuit board in an electronic apparatus (not shown in the drawings) with a bottom end portion thereof facing the solid circuit board so that the electrical connector 10 is fixed in its entirety to the solid circuit board. For example, an FPC constituting a flat circuit device as explained later is inserted through the opening 12 into the housing 11 which is mounted on the solid circuit board.

Figure 9:
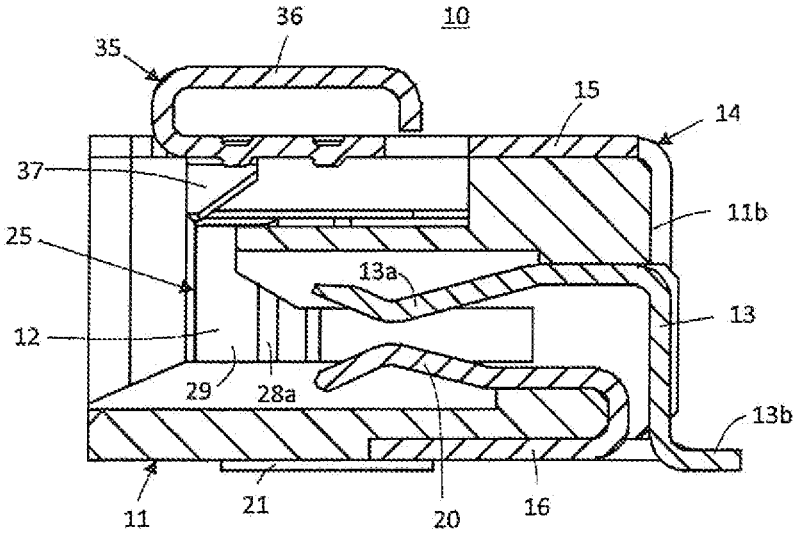
FIG. 9 is a schematic cross sectional view taken along line IX-IX on FIG. 3.

A plurality of conductive contacts 13, each of which is made of resilient conductive material, are provided on the housing 11 of the electrical connector 10 to be arranged in a longitudinal direction of the housing 11. Each of the conductive contacts 13 has a contacting portion 13*a* positioned in the housing 11, as shown in FIG. 4 and FIG. 9 which is the schematic cross sectional view taken along line IX-IX on FIG. 3, and a connecting terminal portion 13*b* projecting from the rear end portion 11*b* of the housing 11 to the outside of the housing 11, as shown in FIG. 2 and FIG. 9. The contacting portion 13*a* of the conductive contact 13 is operative to come into contact with a corresponding one of connecting terminals provided on the FPC inserted in the housing 11 from the side of a top end portion opposite to the bottom end portion of the housing 11 so as to be electrically connected with the same, and the connecting terminal portion 13*b* of the conductive contact 13 is operative to be electrically connected with a signal terminal provided on the solid circuit board on which the housing 11 is mounted, for example, by means of soldering. Thereby, the connecting terminals provided on the FPC inserted in the housing 11 are electrically connected through the conductive contacts 13 with the signal terminals provided on the solid circuit board on which the housing 11 is mounted.

The electrical connector 10 has also a conductive shell member 14 mounted on the housing 11 for covering an outer surface of the housing 11 except the front end portion 11*a* surrounding the opening 12, a major part of the rear end portion, and a part of the bottom end portion of the housing 11. That is, the conductive shell member 14 is provided for covering partially the housing 11 and a major part of each of the left and right side end portions 11*c* and 11*d* of the housing 11 is covered by the conductive shell member 14.

The conductive shell member 14 is formed by means of processing a resilient metal thin plate and grounded to be operative to contribute to adjustment on characteristic impedance of each of the conductive contacts 13 and to shield the conductive contacts 13 arranged on the housing 11 from electromagnetic wave noises coming from the outside.

Figure 6:
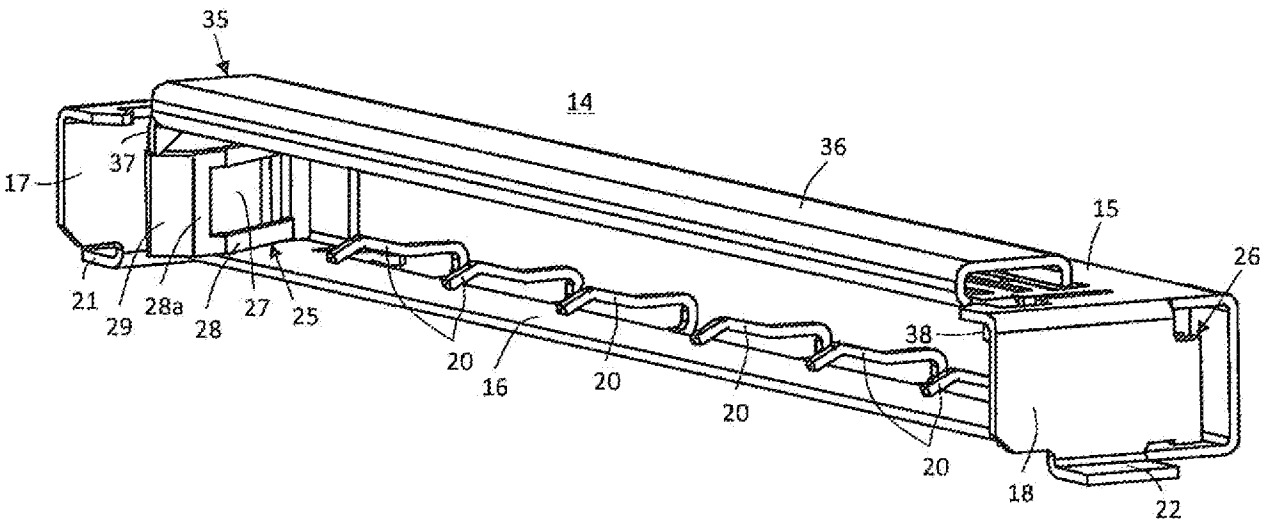
FIG. 6 is a schematic front, top and right side perspective view showing a conductive shell member provided to be employed in the embodiment shown in each of FIGS. 1 and 2.
Figure 7:
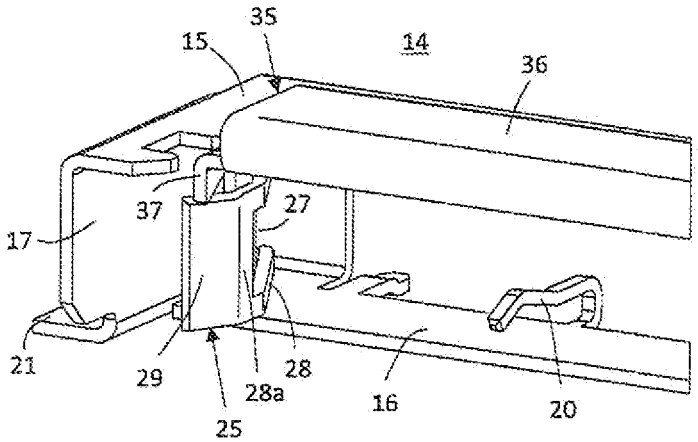
FIG. 7 is a schematic enlarged partial perspective view showing a part of the conductive shell member shown in FIG. 6.
Figure 8:
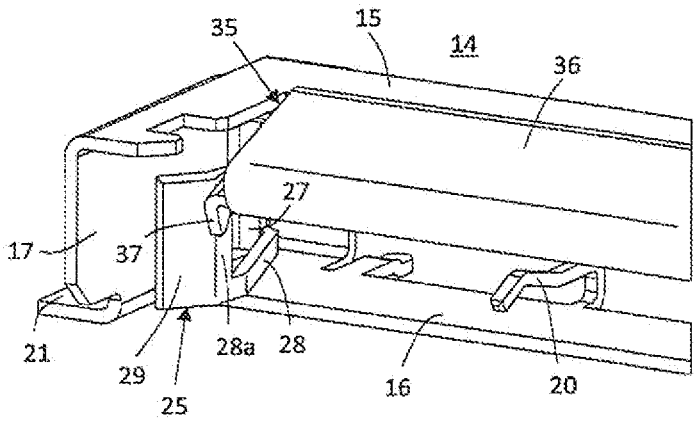
FIG. 8 is a schematic enlarged partial perspective view showing a part of the conductive shell member shown in FIG. 6.

As shown in FIG. 6 which is a schematic front, bottom and left side perspective view showing the conductive shell member 14, FIG. 7 which is a schematic enlarged partial perspective view showing a part of the conductive shell member 14 and FIG. 8 which is a schematic enlarged partial perspective view showing the part of the conductive shell member 14 shown in FIG. 7, the conductive shell member 14 is provided with an upper portion 15 for covering a major part of the top end portion of the housing 11, a lower portion 16 for covering a part of the bottom end portion of the housing 11, a left end wall portion 17 for covering the major part of the left side end portion 11*c* of the housing 11, a right end wall portion 18 for covering the major part of the right side end portion 11*d* of the housing 11, a front end portion positioned at the side of the front end portion 11*a* of the housing 11 for forming an opening and a rear end portion positioned at the side of the rear end portion 11*b* of the housing 11 for forming an opening.

The lower portion 16 of the conductive shell member 14 is provided with a plurality of grounding contacts 20, each of which extends from the rear end portion of the conductive shell member 14 to be bent into an inside of the conductive shell member 14 toward the front end portion of the conductive shell member 14, as shown in FIG. 9. Each of the grounding contacts 20 is operative to come into contact with a ground connecting terminal provided on the FPC inserted in the housing 11 through the opening 12 provided thereon from the side of the lower portion 16 of the conductive shell member 14. The left and right end wall portions 17 and 18 of the conductive shell member 14 are provided with board connecting portions 21 and 22, respectively. Each of the board connecting portions 21 and 22 is electrically connected with a grounded portion provided on the solid circuit board on which the housing 11 is mounted, for example, by means of soldering.

With the grounding contacts 20 and the board connecting portions 21 and 22 thus provided on the conductive shell member 14, the ground connecting terminals provided on the FPC inserted in the housing 11 are electrically connected through the conductive shell member 14 with the grounded portion provided on the solid circuit board on which the housing 11 is mounted. Each of the board connecting portions 21 and 22 is operative to supply the conductive shell member 14 with a ground potential from the solid circuit board and to be used for mounting the housing 11 on the solid circuit board.

As shown clearly in FIGS. 6, 7 and 8, the conductive shell member 14 is also provided with holding portions 25 and 26 respectively at left and right end portions thereof. The holding portion 25 is formed to extend from a rear end of the left end wall portion 17 of the conductive shell member 14 into the inside of the housing 11 toward the front end portion of the conductive shell member 14, that is, toward the front end portion 11*a* of the housing 11 and the holding portion 26 is formed to extend from a rear end of the right end wall portion 18 of the conductive shell member 14 into the inside of the housing 11 toward the front end portion of the conductive shell member 14, that is, toward the front end portion 11*a* of the housing 11.

Each of the holding portions 25 and 26 is formed integrally in the conductive shell member 14 to constitute a resilient movable portion. The holding portion 25 is operative to approach or go way from the left end wall portion 17 of the conductive shell member 14 with a linear fulcrum placed between the rear end of the left end wall portion 17 and the holding portion 25 and the holding portion 26 is operative to approach or go way from the right end wall portion 18 of the conductive shell member 14 with a linear fulcrum placed between the rear end of the right end wall portion 18 and the holding portion 26.

The holding portion 25 extending from the rear end of the left end wall portion 17 of the conductive shell member 14 is provided thereon with a frame-shaped part 28 forming a rectangular engaging opening 27 and a slant surface 29 formed on a free-end part of the holding portion 25 extending from the frame-shaped part 28. A portion 28*a* of the frame-shaped part 28 of the holding portion 25 is operative to engage with an engaging portion of the FPC inserted in the housing 11 through the opening 12 provided thereon.

The holding portion 26 extending from the rear end of the right end wall portion 18 of the conductive shell member 14 is constituted in the same manner as the holding portion 25. Therefore, as shown in FIG. 1, the holding portion 26 is provided thereon with a frame-shaped part 31 forming a rectangular engaging opening 30 and a slant surface 32 formed on a free-end part of the holding portion 26 extending from the frame-shaped part 31. A portion 31*a* of the frame-shaped part 31 of the holding portion 26 is operative to engage with an engaging portion of the FPC inserted in the housing 11 through the opening 12 provided thereon.

When the FPC is inserted into the housing 11 through the opening 12 provided thereon, each of the holding portions 25 and 26 extending respectively from the rear end of the left end wall portion 17 and the rear end of the right end wall portion 18 of the conductive shell member 14 is operative to cause each of the portion 28*a* of the frame-shaped part 28 and the portion 31*a* of the frame-shaped part 31 to engage with the engaging portion of the FPC inserted in the housing 11 so as to hold the FPC.

The conductive shell member 14 is further provided with a releasing portion 35 formed integrally in the conductive shell member 14 to constitute a resilient movable portion connected with the upper portion 15 of the conductive shell member 14, as clearly shown in FIGS. 6 to 9. The releasing portion 35 has a manipulatable part 36 which is formed by folding back a flat plate, which extends from the upper portion 15 of the conductive shell member 14 toward the front end portion of the conductive shell member 14, to the rear end portion of the conductive shell member 14 at a front end portion of the flat plate and a pair of engaging projections 37 and 38 which are provided respectively at both end portions of the manipulatable part 36 positioned respectively close to the left and right end wall portions 17 and 18 of the conductive shell member 14, as shown also in FIGS. 1 and 3.

When the conductive shell member 14 is mounted on the housing 11, the manipulatable part 36 of the releasing portion 35 elongates in a direction along which the conductive contacts 13 are arranged, that is, in the longitudinal direction of the housing 11, so that a longitudinal direction of the manipulatable part 36 is set along the longitudinal direction of the housing 11 and the engaging projections 37 and 38 are provided at the end portions in the longitudinal direction of the manipulatable part 36. Each of the engaging projections 37 and 38 is formed in the shape of a triangle plate projecting downward from the end portion of the manipulatable part 36.

When the manipulatable part 36 of the releasing portion 35 is manipulated to be moved toward the inside of the conductive shell member 14 by pressing, the manipulatable part 36 is entirely moved downward in an operating direction which intersects the longitudinal direction of the manipulatable part 36, that is, the direction along which the conductive contacts 13 are arranged, with a linear fulcrum placed between the upper portion 15 of the conductive shell member 14 and the manipulatable part 36. On that occasion, as shown in FIG. 8, with such a movement of the manipulatable part 36 in the operating direction, the engaging projection 37 of the releasing portion 35 comes to contact with the slant surface 29 of the holding portion 25 to cause the holding portion 25 to move to approach the left end wall portion 17 of the conductive shell member 14 with the linear fulcrum placed between the rear end of the left end wall portion 17 and the holding portions 25. Similarly, although not shown in the drawings, with the movement of the manipulatable part 36 in the operating direction, the engaging projection 38 of the releasing portion 35 comes to contact with the slant surface 32 of the holding portion 26 to cause the holding portion 26 to move to approach the right end wall portion 18 of the conductive shell member 14 with the linear fulcrum placed between the rear end of the right end wall portion 18 and the holding portions 26.

After that, the manipulatable part 36 of the releasing portion 35 is made free from the manipulation by pressing, the releasing portion 35 is moved by means of its own resiliency to go away from the lower portion 16 of the conductive shell member 14 with the linear fulcrum placed between the upper portion 15 of the conductive shell member 14 and the manipulatable part 36 so as to be restored in its entirety to its former condition. With such a movement of the releasing portion 35, the engaging projections 37 and 38 provided on the manipulatable part 36 are put in disengagement respectively from the slant surface 29 of the holding portion 25 and the slant surface 32 of the holding portion 26, so that the holding portion 25 is moved by means of its own resiliency to go away from the left end wall portion 17 of the conductive shell member 14 with the linear fulcrum placed between the end of the left end wall portion 17 and the holding portion 25 so as to be restored to its former condition and the holding portion 26 is moved by means of its own resiliency to go away from the right end wall portion 18 of the conductive shell member 14 with the linear fulcrum placed between the end of the right end wall portion 18 and the holding portion 26 so as to be restored to its former condition In a condition wherein the conductive shell member 14 is mounted on the housing 11 and the manipulatable part 36 of the releasing portion 35 is free from the manipulation by pressing, as shown in FIG. 9, the portion 28*a* of the frame-shaped part 28 provided on the holding portion 25 is positioned in the opening 12 provided on the housing 11 and, although not shown in the drawings, the portion 31*a* of the frame-shaped part 31 provided on the holding portion 26 is also positioned in the opening 12 provided on the housing 11. When the FPC is inserted into the housing 11 through the opening 12 provided thereon under the condition wherein the portion 28*a* of the frame-shaped part 28 provided on the holding portion 25 and the portion 31*a* of the frame-shaped part 31 provided on the holding portion 26 are positioned in the opening 12 provided on the housing 11, each of the portion 28*a* of the frame-shaped part 28 provided on the holding portion 25 and the portion 31*a* of the frame-shaped part 31 provided on the holding portion 26 engages with the engaging portion provided on the FPC so that each of the holding portions 25 and 26 is operative to hold the FPC.

Figure 10:
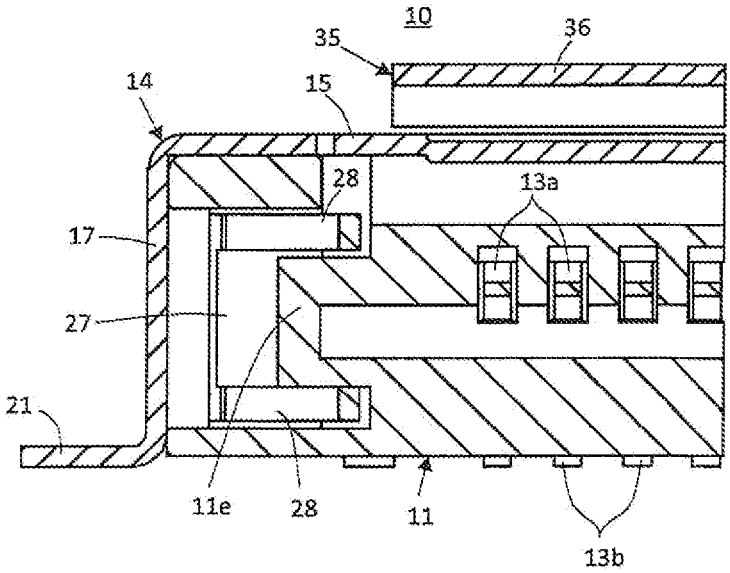
FIG. 10 is a schematic enlarged partial cross sectional view showing a part of a cross section taken along line X-X on FIG. 3.

Further, as shown in FIG. 10 showing a part of a cross section taken along line X-X on FIG. 3, a left guiding projection 11*e* provided on the housing 11 is inserted in the rectangular engaging opening 27 formed on the holding portion 25 and, although not shown in the drawings, a right guiding projection provided on the housing 11 to correspond to the left guiding projection 11*e* is inserted in the rectangular engaging opening 30 formed on the holding portion 26. Thereby, when the holding portion 25 is moved to approach or go away from the left end wall portion 17 of the conductive shell member 14 with the linear fulcrum placed between the end of the left end wall portion 17 and the holding portion 25, the left guiding projection 11*e* provided on the housing 11 is operative to guide the holding portion 25 for causing the same to move smoothly. Similarly, when the holding portion 26 is moved to approach or go away from the right end wall portion 18 of the conductive shell member 14 with the linear fulcrum placed between the end of the right end wall portion 18 and the holding portion 26, the right guiding projection provided on the housing 11 is operative to guide the holding portion 26 for causing the same to move smoothly. As a result, each of the holding portions 25 and 26 are able to move quite smoothly in the conductive shell member 14.

Figure 11:
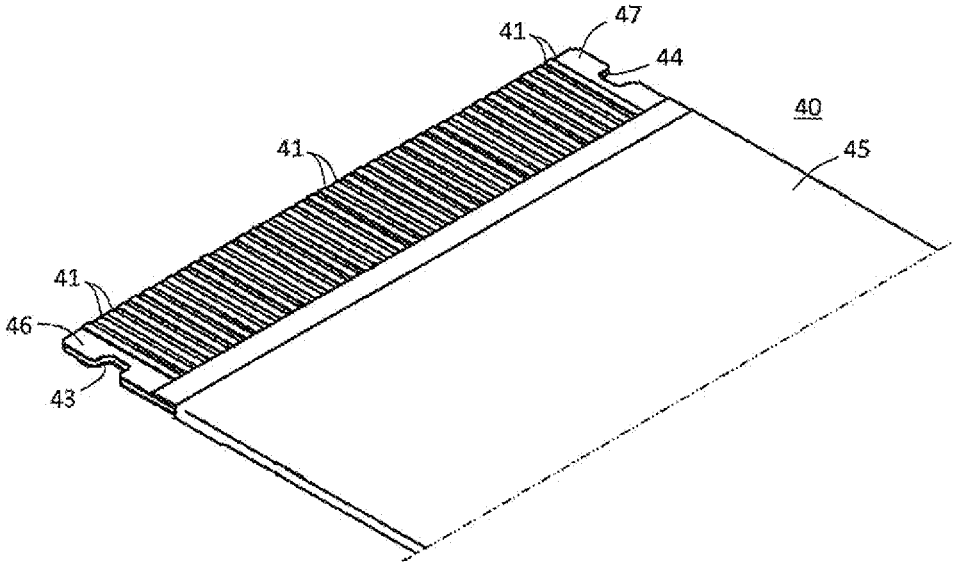
FIG. 11 is a schematic perspective view showing an FPC which is to be inserted into a housing of the embodiment shown in each of FIGS. 1 and 2.

FIG. 11 shows an FPC 40 which is an example of the FPC constituting the flat circuit device to be inserted into the housing 11 of the electrical connector 10 through the opening 12 provided on the housing 11.

Referring to FIG. 10, a plurality of signal connecting terminals 41 each made of conductive material and formed into a rectangular plate member are provided on a first surface opposite to a second surface of the FPC 40 to be arranged at a top end portion of the first surface. Although an illustrative explanation is omitted, a ground connecting flat portion is also provided on the second surface of the FPC 40. Further, a pair of engaging edged recesses 43 and 44 are provided respectively on side end portions of the FPC 40 which are opposite each other with the signal connecting terminals 41 between. Each of the engaging edged recesses 43 and 44 constitutes the engaging portion provided on the FPC 40. A top flat portion 46 is formed at the outside of the engaging edged recess 43 provided on one of the side end portions of the FPC 40 and another top flat portion 47 is formed at the outside of the engaging edged recess 44 provided on the other of the side end portions of the FPC 40.

The FPC 40 is wrapped with a covering film 45 except a portion thereof on which the signal connecting terminals 41, the ground connecting flat portion, the engaging edged recesses 43 and 44 and the top flat portions 46 and 47 are provided.

Figure 12:
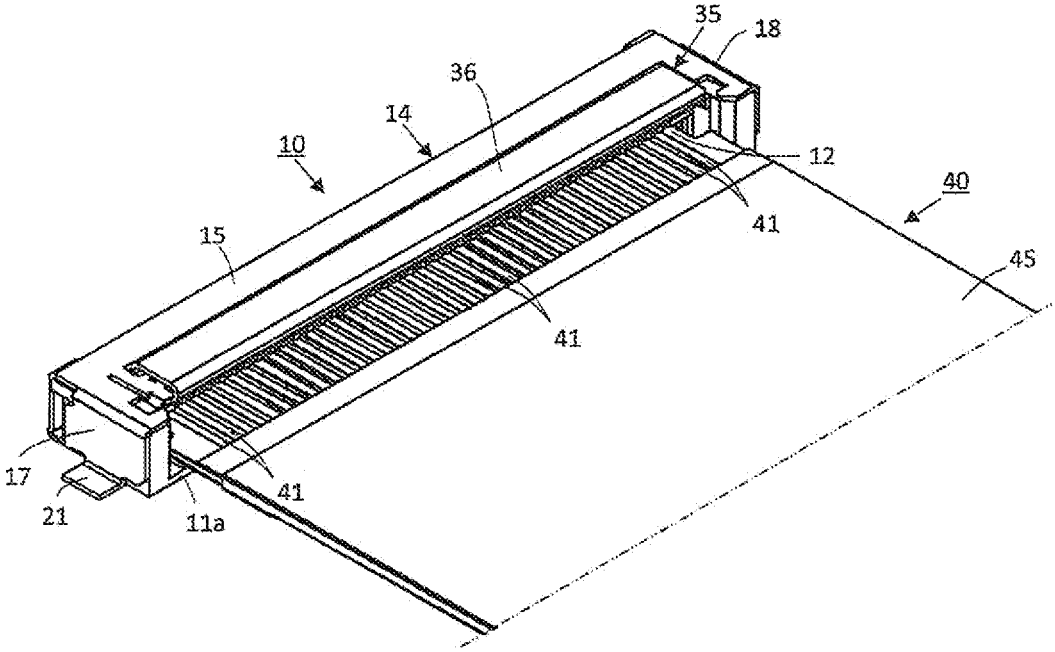
FIG. 12 is a schematic perspective view showing a situation wherein the FPC has been inserted in the embodiment shown in each of FIGS. 1 and 2.

FIG. 12 shows the electrical connector 10 and the FPC 40 which is inserted in the housing 11 of the electrical connector 10 through the opening 12 provided on the housing 11. In FIG. 12, the first surface of the FPC 40, on which the signal connecting terminals 41 are provided, faces upward to appear on the side of the upper portion 15 of the conductive shell member 14, and the second surface of the FPC 40, on which the ground connecting flat portion is provided, faces downward to be not shown. A top end of a part of the FPC 40 on which the signal connecting terminal 41 are provided is postured to be parallel with the rear end portion 11*b* of the housing 11 in a condition wherein the FPC 40 is properly inserted into the housing 11 through the opening 12 provided on the housing 11.

Figure 13:
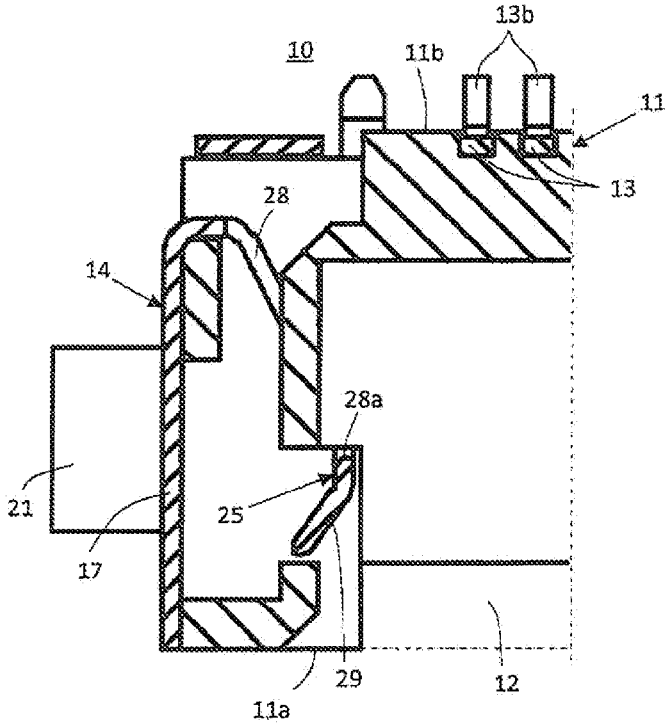
FIG. 13 is a schematic partial cross sectional view showing a situation wherein any FPC is not inserted yet into the embodiment shown in each of FIGS. 1 and 2.

Just before the FPC 40 is inserted in the housing 11 of the electrical connector 10 through the opening 12 provided on the housing 11 as shown in FIG. 12, the portion 28*a* of the frame-shaped part 28 provided on the holding portion 25 is positioned in the opening 12 provided on the housing 11 as shown in FIG. 13, and, although not shown in the drawings, the portion 31*a* of the frame-shaped part 31 provided on the holding portion 26 is also positioned in the opening 12 provided on the housing 11 under the condition wherein the manipulatable part 36 of the releasing portion 35 is not manipulated by pressing.

Figure 14:
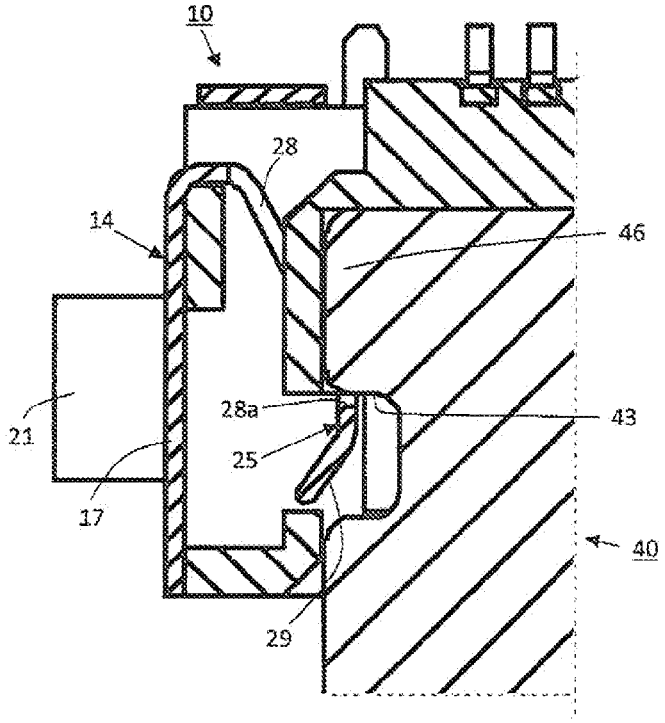
FIG. 14 is a schematic partial cross sectional view showing a situation wherein the FPC has been inserted into the embodiment shown in each of FIGS. 1 and 2 to be held by a holding portion of the conductive shell member employed in the embodiment shown in each of FIGS. 1 and 2.

Then, the FPC 40 is inserted into the housing 11 through the opening 12 provided to open on the front end portion 11*a* of the housing 11 with the top end thereof facing the rear end portion 11*b* of the housing 11. With the FPC 40 inserted continuously into the housing 11, the top flat portion 46 formed at the outside of the engaging edged recess 43 of the FPC 40 comes into contact with the slant surface 29 of the holding portion 25 and thereby causes the holding portion 25 to move to approach the left end wall portion 17 of the conductive shell member 14 with the linear fulcrum placed between the end of the left end wall portion 17 and the holding portion 25. Then, the top flat portion 46 passes over the slant surface 29 to reach a location facing the rear end portion 11*b* of the housing 11. Thereby, the holding portion 25 is moved by means of its own resiliency to go away from the left end wall portion 17 of the conductive shell member 14 with the linear fulcrum placed between the end of the left end wall portion 17 and the holding portion 25 so as to be restored to its former condition and to cause the portion 28*a* of the frame-shaped part 28 provided on the holding portion 25 to engage with the engaging edged recess 43 provided on the FPC 40. As a result, the portion 28*a* of the frame-shaped part 28 provided on the holding portion 25 is put in engagement with the engaging edged recess 43 provided on the FPC 40, as shown in FIG. 14.

Similarly, With the FPC 40 inserted continuously into the housing 11, the top flat portion 47 formed at the outside of the engaging edged recess 44 of the FPC 40 comes into contact with the slant surface 32 of the holding portion 26 and thereby causes the holding portion 26 to move to approach the right end wall portion 18 of the conductive shell member 14 with the linear fulcrum placed between the end of the right end wall portion 18 and the holding portion 26. Then, the top flat portion 47 passes over the slant surface 32 to reach a location facing the rear end portion 11*b* of the housing 11. Thereby, the holding portion 26 is moved by means of its own resiliency to go away from the right end wall portion 18 of the conductive shell member 14 with the linear fulcrum placed between the end of the right end wall portion 18 and the holding portion 26 so as to be restored to its former condition and to cause the portion 31*a* of the frame-shaped part 31 provided on the holding portion 26 to engage with the engaging edged recess 44 provided on the FPC 40. As a result, the portion 31*a* of the frame-shaped part 31 provided on the holding portion 26 is put in engagement with the engaging edged recess 44 provided on the FPC 40.

As described above, when the FPC 40 is completely inserted in the housing 11 through the opening 12 provided thereon as shown in FIG. 12, the holding portion 25 is operative to hold the FPC 40 with the portion 28*a* of the frame-shaped part 28 provided on the holding portion 25 for engaging with the engaging edged recess 43 provided on the FPC 40 and the holding portion 26 is also operative to hold the FPC 40 with the portion 31*a* of the frame-shaped part 31 provided on the holding portion 26 for engaging with the engaging edged recess 43 provided on the FPC 40. Thereby, the FPC 40 inserted in the housing 11 is held by each of the holding portions 25 and 26 so as to be prevented from getting out of the housing 11 unwillingly. Further, when the portion 28*a* of the frame-shaped part 28 provided on the holding portion 25 engages with the engaging edged recess 43 provided on the FPC 40 and the portion 31*a* of the frame-shaped part 31 provided on the holding portion 26 engages with the engaging edged recess 44 provided on the FPC 40, a resistive force acting on the FPC 40 moved in the housing 11 is suddenly reduced and therefore an operator who inserts the FPC 40 into the housing 11 through the opening 12 provided thereon is able to feels a certain click through the FPC 40.

Under a condition wherein the FPC 40 inserted in the housing 11 through the opening 12 provided thereon takes up a predetermined appropriate position in the housing 11 so as to be held by each of the holding portions 25 and 26 in such a manner as described above, the contacting portion 13*a* of each of the conductive contacts 13 arranged on the housing 11 comes into press-contact with a corresponding one of the signal connecting terminals 41 provided on the FPC 40, which is inserted in the housing 11 with the first surface thereof provided thereon with the signal connecting terminals 41 and facing upward, from the side of the upper portion 15 of the conductive shell member 14. As a result, the signal connecting terminals 41 provided on the FPC 40 inserted in the housing 11 are electrically connected through the conductive contact 13 with the signal terminals provided on the solid circuit board on which the housing 11 is mounted.

Further, each of the grounding contacts 20 extending from the rear end portion of the conductive shell member 14 to be bent into the inside of the conductive shell member 14 comes into contact with the ground connecting flat portion provided on the second surface of the FPC 40 inserted in the housing 11 from the side of the lower portion 16 of the conductive shell member 14. As a result, the ground connecting flat portion provided on the FPC 40 inserted in the housing 11 is electrically connected through the conductive shell member 14 including the grounding contacts 20 with the grounded portion provided on the solid circuit board on which the housing 11 is mounted.

Figure 15:
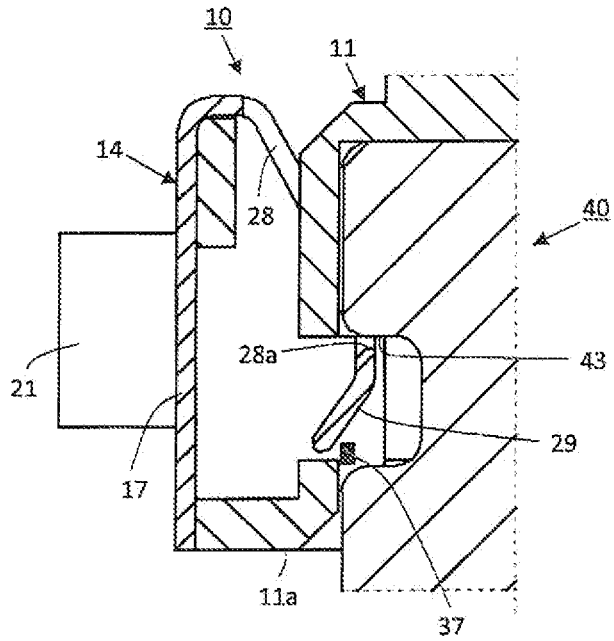
FIG. 15 is a schematic partial cross sectional view showing a situation wherein the FPC inserted in the housing is put in a condition just before releasing from holding by the holding portion of the conductive shell member.

After that, when the manipulatable part 36 of the releasing portion 35 is manipulated to be moved downwardly toward the inside of the conductive shell member 14 by pressing under the condition wherein the FPC 40 inserted in the housing 11 is held by the holding portions 25 and 26, the releasing portion 35 is entirely moved downward in an operating direction which intersects the longitudinal direction of the manipulatable part 36, that is, the direction along which the conductive contacts 13 are arranged, with the linear fulcrum placed between the upper portion 15 of the conductive shell member 14 and the manipulatable part 36. With such a movement of the releasing portion 35 in the operating direction, as shown in FIG. 15, the engaging projection 37 of the releasing portion 35 moves downward to approach the slant surface 29 of the holding portion 25 and, although not shown in the drawings, the engaging projection 38 of the releasing portion 35 moves also downward to approach the slant surface 32 of the holding portion 26. In FIG. 15, a cross section of the engaging projection 37 of the releasing portion 35 appears above an imaginary plane including thereon a cross section of the FPC 40 in a direction perpendicular to the paper on which the drawings are described.

Figure 16:
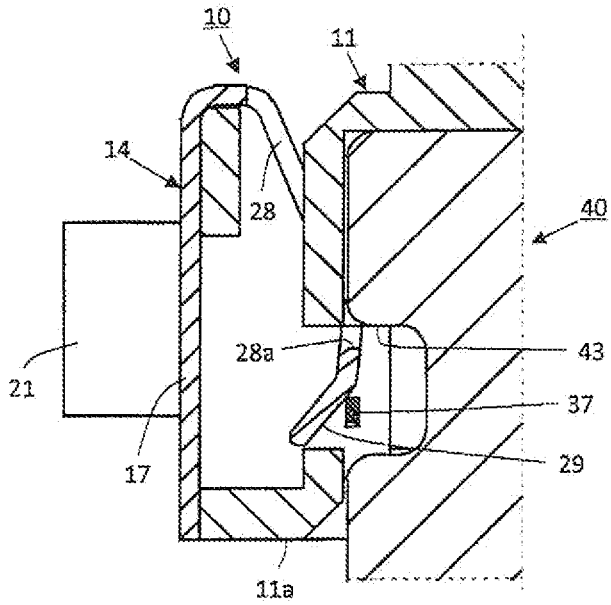
FIG. 16 is a schematic partial cross sectional view showing a situation wherein a releasing portion of the conductive shell member employed in the embodiment shown in each of FIGS. 1 and 2 is on the way to release of the FPC from the holding by the holding portion of the conductive shell member.

With a further downward movement of the releasing portion 35, as shown in FIG. 16, the engaging projection 37 of the releasing portion 35 moves continuously downward to come into contact with the slant surface 29 of the holding portion 25 and, although not shown in the drawings, the engaging projection 38 of the releasing portion 35 moves also continuously downward to come into contact with the slant surface 32 of the holding portion 26. The engaging projection 37 in contact with the slant surface 29 of the holding portion 25 operative to commence releasing the FPC 40 from holding by the holding portion 25 and the engaging projection 38 in contact with the slant surface 32 of the holding portion 26 operative to commence releasing the FPC 40 from holding by the holding portion 26.

The engaging projection 37 of the releasing portion 35 which is in contact with the slant surface 29 of the holding portion 25 and in process of downward movement, causes the holding portion 25 to move to approach the left end wall portion 17 of the conductive shell member 14 with the linear fulcrum placed between the rear end of the left end wall portion 17 and the holding portions 25. Similarly, the engaging projection 38 of the releasing portion 35 which is in contact with the slant surface 32 of the holding portion 26 and in process of downward movement, causes the holding portion 26 to move to approach the right end wall portion 18 of the conductive shell member 14 with the linear fulcrum placed between the rear end of the right end wall portion 18 and the holding portion 26.

Figure 17:
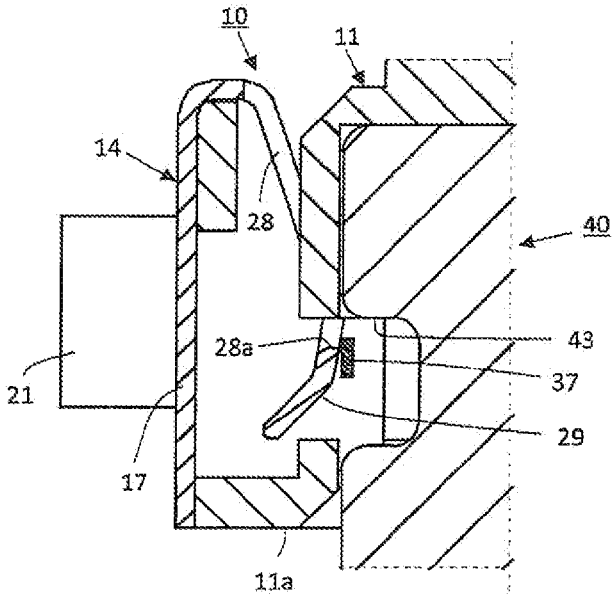
FIG. 17 is a schematic partial cross sectional view showing a situation wherein the releasing portion of the conductive shell member has released the FPC from the holding by the holding portion of the conductive shell member.

Thereby, when releasing portion 35 accompanied with the engaging projections 37 and 38 has finished its downward movement, as shown in FIG. 17, the engaging projection 37 of the releasing portion 35 is operative to disengage the portion 28*a* of the frame-shaped part 28 provided on the holding portion 25 from the engaging edged recess 43 provided on the FPC 40 and, although not shown in the drawings, the engaging projection 38 of the releasing portion 35 is operative also to disengage the portion 31*a* of the frame-shaped part 31 provided on the holding portion 26 from the engaging edged recess 43 provided on the FPC 40. As a result, the FPC 40 is released from the holding by each of the holding portions 25 and 26 so as to be put in a condition to be caused intentionally to get out of the housing 11 through the opening 12 provided thereon.

After that, the manipulatable part 36 of the releasing portion 35 is made free from the manipulation by pressing, the releasing portion 35 is moved by means of its own resiliency upward toward the outside of the housing 11 with the linear fulcrum placed between the upper portion 15 of the conductive shell member 14 and the manipulatable part 36 so as to be restored in its entirety to its former condition. With the upward movement of the releasing portion 35, the engaging projections 37 and 38 provided on the manipulatable part 36 are moved away respectively from the slant surface 29 of the holding portion 25 and the slant surface 32 of the holding portion 26, so that the holding portion 25 is moved by means of its own resiliency to go away from the left end wall portion 17 of the conductive shell member 14 with the linear fulcrum placed between the end of the left end wall portion 17 and the holding portion 25 so as to be restored to its former condition and the holding portion 26 is moved by means of its own resiliency to go away from the right end wall portion 18 of the conductive shell member 14 with the linear fulcrum placed between the end of the right end wall portion 18 and the holding portion 26 so as to be restored to its former condition.

Figure 18:
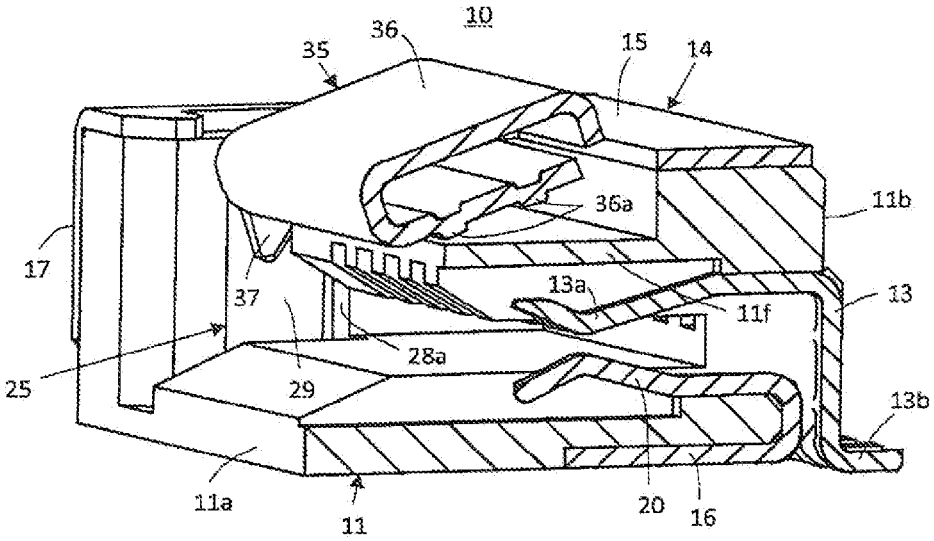
FIG. 18 is a schematic partial perspective view including partial cross sections and used for explaining a manipulatable part of the releasing portion of the conductive shell member.

As shown in FIG. 18, the manipulatable part 36 of the releasing portion 35 is provided on a lower portion thereof positioned in the inside of the conductive shell member 14 with a pair of ribs 36*a* elongating in parallel with each other along the longitudinal direction of the manipulatable part 36.

With the ribs 36*a* thus provided, the manipulatable part 36 is reinforced to have required stiffness. When the manipulatable part 36 is manipulated by pressing so as to shift downward with the linear fulcrum placed between the upper portion 15 of the conductive shell member 14 and the manipulatable part 36, one of the ribs 36*a* comes into contact with an upper surface of an upper plate portion 11*f* of the housing 11 so as to prevent the manipulatable part 36 from shifting downward excessively. Thereby, such a situation that the manipulatable part 36 of the releasing portion 35 is manipulated by pressing excessively and moved downward excessively to be deformed plastically or damaged is able to be avoided and an operator who manipulates the manipulatable part 36 of the releasing portion 35 by pressing is able to sense a condition wherein the rib 36*a* comes into contact with the upper surface of the upper plate portion 11*f* of the housing 11 and then to control the manipulation on the manipulatable part 36.

In the electrical connector 10 thus constituted as the embodiment of electrical connector according to the present invention, as described above, when the FPC 40 is inserted into the housing 11 through the opening 12 provided thereon, the contacting portion 13*a* of each of the conductive contacts 13 arranged on the housing 11 comes into contact with the corresponding one of the signal connecting terminals 41 provided on the FPC 40 inserted in the housing 11 and the holding portions 25 and 26 formed integrally in the conductive shell member 14 are put in engagement respectively with the engaging edged recesses 43 and 44 provided on the FPC 40 inserted in the housing 11 for holding the same. As a result, the FPC 40 inserted in the housing 11 are held by the holding portions 25 and 26 so as to be surely prevented from getting out of the housing 11 unwillingly and the conductive contacts 13 arranged on the housing 11 are stably kept in electrical connection with the signal connecting terminals 41 provided on the FPC 40 inserted in the housing 11.

Then, when the manipulatable part 36 of the releasing portion 35, which is also formed integrally in the conductive shell member 14 in addition to the holding portions 25 and 26, is manipulated by pressing under the condition wherein the FPC 40 inserted in the housing 11 is held by the holding portions 25 and 26, the releasing portion 35 accompanied with the engaging projections 37 and 38 is moved downward and the engaging projections 37 and 38 of the releasing portion 35 come into engagement respectively with the holding portions 25 and 26 to move the same to go away from the FPC 40 inserted in the housing 11. As a result, the FPC 40 inserted in the housing 11 is released from the holding by each of the holding portions 25 and 26 so as to be able to get out of the housing 11.

Accordingly, the FPC 40 inserted in the housing 11 through the opening 12 provided thereon can be put in the holding by the holding portions 25 and 26 formed integrally in the conductive shell member 14 to be surely prevented from getting out of the housing 11 unwillingly and then released from the holding by the holding portions 25 and 26 to be able to get out of the housing 11 with an improved structure with which the electrical connector 10 can be miniaturized on the whole and the number of structural parts can be reduced with the holding portions 25 and 26 and the releasing portion 35 each formed integrally in the conductive shell member 14.

Further, the FPC 40 inserted in the housing 11 and put in holding by the holding portions 25 and 26 formed integrally in the conductive shell member 14 is released from the holding by the holding portions 25 and 26 only with the manipulation on the manipulatable part 36 of the releasing portion 35 formed integrally in the conductive shell member 14 for moving the releasing portion 35 downward in the operating direction intersecting the direction along which the conductive contacts 13 are arranged. On that occasion, the manipulation on the manipulatable part 36 of the releasing portion 35 is done with pressing the manipulatable part 36 and therefore considerably simple. Besides, since the manipulatable part 36 of the releasing portion 35 elongates in the direction along which the conductive contacts 13 are arranged, the manipulation applied on the manipulatable part 36 of the releasing portion 35 can be easily and surely carried out. Consequently, the FPC 40 inserted in the housing 11 can be easily released from the holding by the holding portions 25 and 26 with a considerably simple and easy manipulation to the releasing portion 35.

Incidentally, although the FPC 40 is inserted in the housing 11 with the first surface thereof, which is provided thereon with the signal connecting terminal 41 and faces upward, under a condition wherein the contacting portion 13*a* of each of the conductive contacts 13 provided for coming into contact with the signal connecting terminal 41 on the first surface of the FPC 40 is arranged to project into the inside of the opening 12 provided on the housing 11 from the side of the upper portion 15 of the conductive shell member 14, in the electrical connector 10 described above, it is also possible to modify the electrical connector 10 in such a manner that the FPC 40 is inserted in the housing 11 with the first surface thereof, which is provided thereon with the signal connecting terminal 41 and faces downward, under a condition wherein the contacting portion 13*a* of each of the conductive contacts 13 provided for coming into contact with the signal connecting terminal 41 on the first surface of the FPC 40 is arranged to project into the inside of the opening 12 provided on the housing 11 from the side of the lower portion 16 of the conductive shell member 14.

The invention claimed is:

1. An electrical connector comprising;

a housing made of insulator to be mounted on a solid circuit board and provided thereon with an opening through which a flat circuit device is inserted into the housing, a plurality of conductive contacts arranged on the housing, each of said conductive contacts having a contacting portion positioned in the housing and a connecting terminal portion projecting from the housing to the outside thereof and being operative to come into contact with a connecting terminal provided on the flat circuit device inserted in the housing through the opening provided thereon, and a conductive shell member mounted on the housing for covering partially the same and provided with a holding portion formed integrally therein to be put in engagement with the flat circuit device inserted in the housing for holding the same and with a releasing portion formed integrally therein to be manipulated to release the holding portion from the engagement with the flat circuit device inserted in the housing, wherein the holding portion extends into the inside of the housing from each of a pair of end wall portions of the conductive shell member covering respectively a pair of side end portions of the housing to be movable for engaging with the flat circuit device inserted in the housing and then disengaging from the flat circuit device inserted in the housing, and the releasing portion is connected with the conductive shell member to be movable entirely in an operating direction which intersects a direction along which the conductive contacts are arranged and provided thereon with a manipulatable part elongating in the direction along which the conductive contacts are arranged and an engaging projection operative to engage with the holding portion to move the same to be released from the engagement with the flat circuit device inserted in the housing.

2. An electrical connector according to claim 1, wherein each of the holding portion and the releasing portion formed integrally in the conductive shell member is provided for constituting a resilient movable portion.

3. An electrical connector according to claim 1, wherein the holding portion is formed to extend from the end wall portion of the conductive shell member toward the opening provided on the housing and provided thereon with an opening forming part for forming an engaging opening, a portion of said opening forming part being operative to engage with the flat circuit device inserted in the housing.

4. An electrical connector according to claim 3, wherein the housing is provided thereon with a guiding projection operative to be inserted in the engaging opening formed on the holding portion for guiding the opening forming part of the holding portion when the holding portion moves with a linear fulcrum placed between the end wall portion of the conductive shell member and the holding portion.

5. An electrical connector according to claim 3, wherein the holding portion is provided with a slant surface formed on a free-end part of the opening forming part of the holding portion and operative to move to approach the end wall portion of the conductive shell member with the linear fulcrum placed between the end wall portion of the conductive shell member and the holding portion when the engaging projection of the releasing portion moves in the operating direction in contact with the slant surface.

6. An electrical connector according to claim 1, wherein the releasing portion is provided thereon with a pair of engaging projections formed respectively at ends of the manipulatable part opposite to each other in the direction along which the conductive contacts are arranged.

7. An electrical connector according to claim 1, wherein the releasing portion is operative to move in the operating direction with a linear fulcrum placed between the manipulatable part and the conductive shell member when the manipulatable part is manipulated by pressing.

8. An electrical connector according to claim 7, wherein the releasing portion is operative to cause the engaging projection to move in the operating direction in contact with the holding portion and thereby to cause the holding portion to move to approach the end wall portion of the conductive shell member with the linear fulcrum placed between the end wall portion and the holding portion so as to be released from the engagement with the flat circuit device inserted in the housing when the manipulatable part of the releasing portion is manipulated by pressing under a condition wherein the holding portion engages with the flat circuit device inserted in the housing for holding the same.

9. An electrical connector according to claim 1, wherein the conductive shell member is provided with a grounding contact formed integrally in the conductive shell member to extend into an inside of the housing to be operative to come into contact with a ground connecting portion provided on the flat circuit device.

* * * * *